US008881710B2

(12) United States Patent
Lin et al.

(10) Patent No.: US 8,881,710 B2
(45) Date of Patent: Nov. 11, 2014

(54) BLEED ELEMENT WITH OVERMOLDED SEAL FOR EVAPORATIVE EMISSIONS CANISTER

(75) Inventors: Jhun-Sou Lin, Novi, MI (US); Mark E. Hipp, South Lyon, MI (US); Christopher M. Kersman, Brighton, MI (US); Mark Cobb, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 454 days.

(21) Appl. No.: 13/461,857

(22) Filed: May 2, 2012

(65) Prior Publication Data

US 2013/0291839 A1 Nov. 7, 2013

(51) Int. Cl.
*F02M 33/02* (2006.01)
*F02M 25/08* (2006.01)

(52) U.S. Cl.
CPC ..... *F02M 33/02* (2013.01); *F02M 25/0854* (2013.01)
USPC ..... 123/519; 123/518

(58) Field of Classification Search
CPC ..... F02M 25/0854; F02M 25/0872; F02M 25/0863; F02M 33/02; B01D 225/4516; B01D 53/0415; B01D 53/0423
USPC ..... 123/516, 518–520; 96/131, 134, 135, 96/139, 143, 144, 147, 152; 137/587–589; 55/385.3, 385.4
See application file for complete search history.

(56) References Cited

U.S. PATENT DOCUMENTS 5,776,228 A 7/1998 Meiller
6,537,354 B2 * 3/2003 Meiller et al. ..... 96/139
6,537,355 B2 3/2003 Scardino
6,599,350 B1 * 7/2003 Rockwell et al. ..... 96/135
6,616,737 B1 9/2003 Evans et al.
6,692,556 B2 2/2004 Hayes
6,896,852 B1 * 5/2005 Meiller et al. ..... 422/180
6,928,990 B2 * 8/2005 Meiller et al. ..... 123/519
RE38,844 E 10/2005 Hiltzik
6,959,698 B2 * 11/2005 Ikuma et al. ..... 123/519
6,998,331 B2 2/2006 Avniel
7,051,717 B2 * 5/2006 Meiller et al. ..... 123/518
7,059,306 B2 6/2006 Reddy
7,067,092 B2 6/2006 Hall
7,097,697 B2 * 8/2006 Nakamura et al. ..... 96/134
7,114,492 B2 10/2006 Reddy (Continued)

FOREIGN PATENT DOCUMENTS

EP 1788230 A1 * 5/2007 ..... F02M 25/08

*Primary Examiner* — Mahmoud Gimie
*Assistant Examiner* — John Zaleskas
(74) *Attorney, Agent, or Firm* — James Dottavio; MacMillan, Sobanski & Todd, LLC

(57) ABSTRACT

A deflector mounts a carbon scrubber element at an atmospheric port of an evaporative emissions canister. A substantially cylindrical shell has an open end and a closed end. A spacer plate extends outwardly from the shell. An elastomeric ring is overmolded within the shell at a longitudinal position between the ends. The elastomeric ring has an inner diameter configured to sealingly receive the carbon element. A plurality of vapor apertures are formed in the shell between the spacer plate and the elastomeric ring. A plurality of elastomeric ribs are overmolded by the interior surface within the shell the vapor apertures and the closed end, and are configured to be spaced around the carbon element to suspend the carbon element spaced away from the shell without blocking a gaseous flow from the vapor vents to the carbon element.

16 Claims, 6 Drawing Sheets

(56) References Cited

U.S. PATENT DOCUMENTS

| | | | | |
|---|---|---|---|---|
| 7,118,716 | B2 * | 10/2006 | Meiller et al. | 422/180 |
| 7,134,426 | B2 * | 11/2006 | Uchino et al. | 123/518 |
| 7,159,579 | B2 * | 1/2007 | Meiller et al. | 123/518 |
| 7,160,361 | B2 | 1/2007 | Meiller | |
| 7,294,179 | B2 * | 11/2007 | Kim et al. | 96/121 |
| 7,322,343 | B2 * | 1/2008 | Yamada et al. | 123/519 |
| 7,353,809 | B2 * | 4/2008 | Peterson et al. | 123/516 |
| 7,370,641 | B2 * | 5/2008 | Zuchara et al. | 123/519 |
| 7,448,367 | B1 | 11/2008 | Reddy | |
| 7,455,054 | B2 * | 11/2008 | Oh et al. | 123/519 |
| 7,556,026 | B2 * | 7/2009 | Herald et al. | 123/516 |
| 7,578,285 | B2 | 8/2009 | Buelow | |
| 7,610,904 | B2 * | 11/2009 | Treier et al. | 123/516 |
| 7,753,034 | B2 | 7/2010 | Hoke | |
| 7,909,919 | B2 | 3/2011 | Kosugi | |
| 8,052,768 | B2 * | 11/2011 | Lin et al. | 55/320 |
| 8,062,397 | B2 * | 11/2011 | Lin et al. | 55/320 |
| 8,297,262 | B2 * | 10/2012 | Lang et al. | 123/518 |
| 8,657,927 | B2 * | 2/2014 | Rockwell et al. | 95/268 |
| 2004/0261777 | A1 * | 12/2004 | Ogawa | 123/698 |
| 2005/0061301 | A1 * | 3/2005 | Meiller et al. | 123/519 |
| 2005/0081717 | A1 | 4/2005 | Meiller | |
| 2007/0107705 | A1 | 5/2007 | Hoke | |
| 2007/0119306 | A1 * | 5/2007 | Yamada et al. | 96/131 |
| 2008/0251055 | A1 * | 10/2008 | Schmalz et al. | 123/519 |
| 2010/0224069 | A1 * | 9/2010 | Donadei et al. | 96/141 |
| 2010/0282220 | A1 * | 11/2010 | Lin et al. | 123/519 |
| 2011/0180466 | A1 * | 7/2011 | Kalauch | 210/136 |

* cited by examiner

BLEED ELEMENT WITH OVERMOLDED SEAL FOR EVAPORATIVE EMISSIONS CANISTER

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to bleed elements in evaporative emission canisters for vehicle fuel systems, and, more specifically, to a deflector for retaining a carbon scrubber element.

Evaporative emissions systems are used in conjunction with the fuel systems of gasoline-powered vehicles to prevent release of hydrocarbon fuel vapors into the atmosphere. A typical carbon canister design uses a bleed emission treatment section to provide reduced emissions occurring during the diurnal (i.e., inactive) state of the vehicle. A large primary carbon bed handles the majority of fuel vapor during vehicle use and refueling. A bleed emission region close to the atmospheric vent uses an activated carbon scrubber element to capture low concentration hydrocarbon vapor from being expelled into the environment. Typically, the activated carbon element is held by a plastic molded tube generally open at both ends. This tube provides structure protecting the relatively fragile carbon element. An O-ring seal between this tube and the venting access of the mating shell has been used to assure a tight seal. Another separate molded piece is placed around the bleed tube to act as a bleed deflector or flow diverter so that vapors are routed through a zig-zag path to double back for entry into the bleed tube.

Very limited packaging space is available within the carbon canister. Therefore, it would be desirable to eliminate the separate bleed tube, o-ring seal, and any compliance media packed around the carbon element that is often used to protect the fragile element.

SUMMARY OF THE INVENTION

In one aspect of the invention, a deflector is provided for mounting a carbon scrubber element at an atmospheric port of an evaporative emissions canister. A substantially cylindrical shell has an open end and a closed end. A spacer plate extends outwardly from the shell. An elastomeric ring is overmolded by an interior surface of the shell at a longitudinal position intermediate of the open end and the closed end. The elastomeric ring has an inner diameter configured to sealingly receive the carbon element. A plurality of vapor apertures are formed in the shell located longitudinally between the spacer plate and the elastomeric ring. A plurality of elastomeric ribs are overmolded by the interior surface of the shell and located longitudinally between the vapor apertures and the closed end. The elastomeric ribs are configured to be spaced around the carbon element to suspend the carbon element spaced away from the shell without blocking a gaseous flow from the vapor vents to the carbon element. The open end of the shell is configured to sealingly connect with the atmospheric port.

DETAILED DESCRIPTION OF PREFERRED EMBODIMENTS

Figure 1:
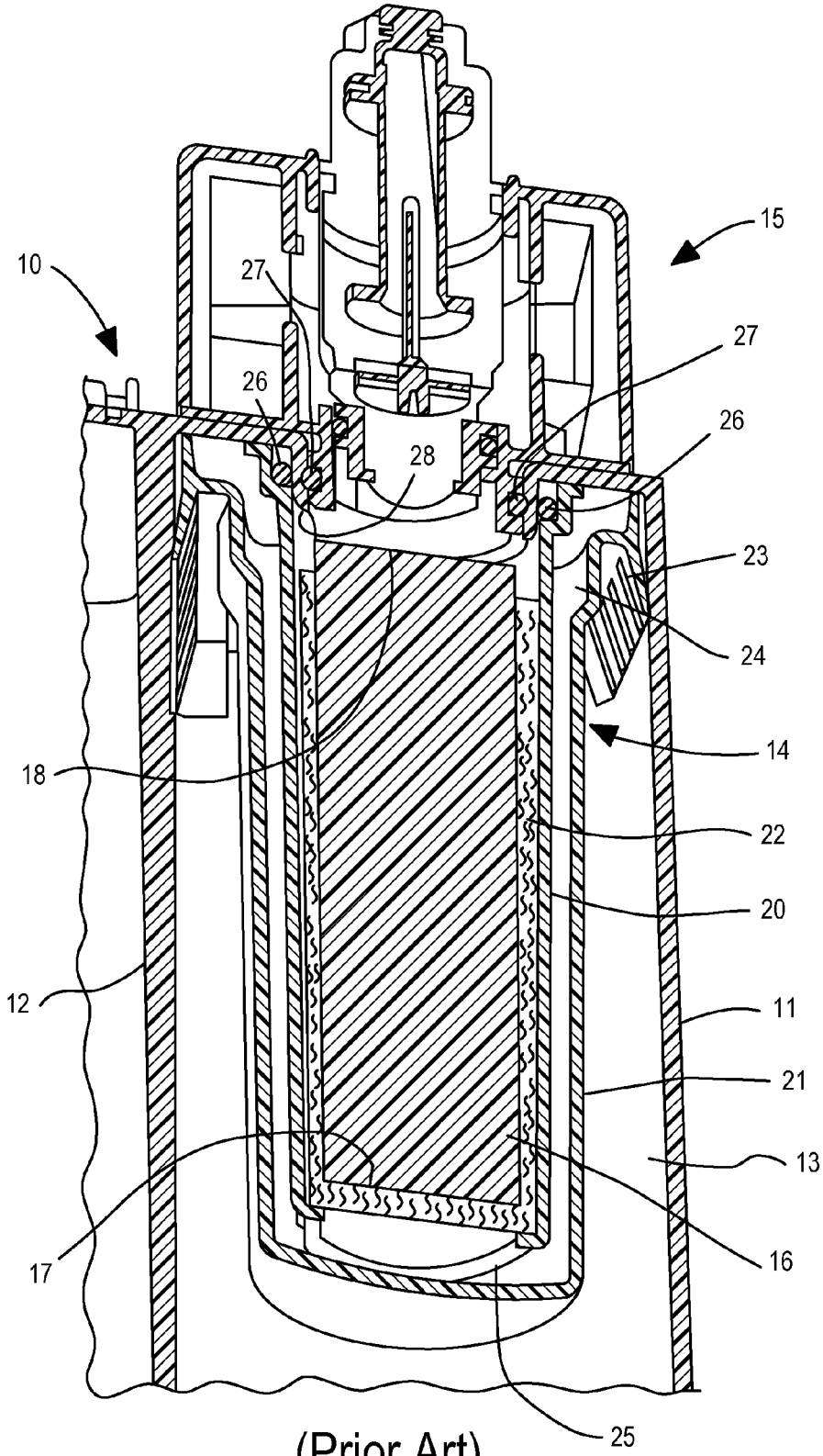
(Prior Art) FIG. 1
FIG. 1 is a cross section showing a conventional bleed assembly with a separate bleed tube and flow diverter.
Figure 2:
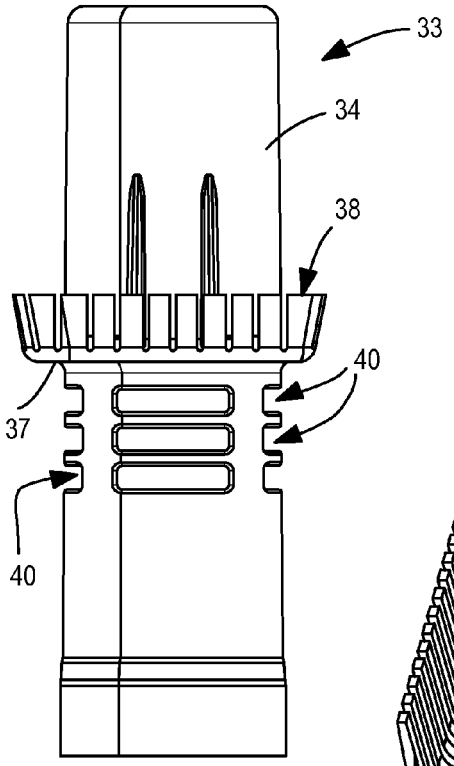
FIG. 2 is a side view of one preferred embodiment of a bleed assembly of the present invention.
Figure 3:
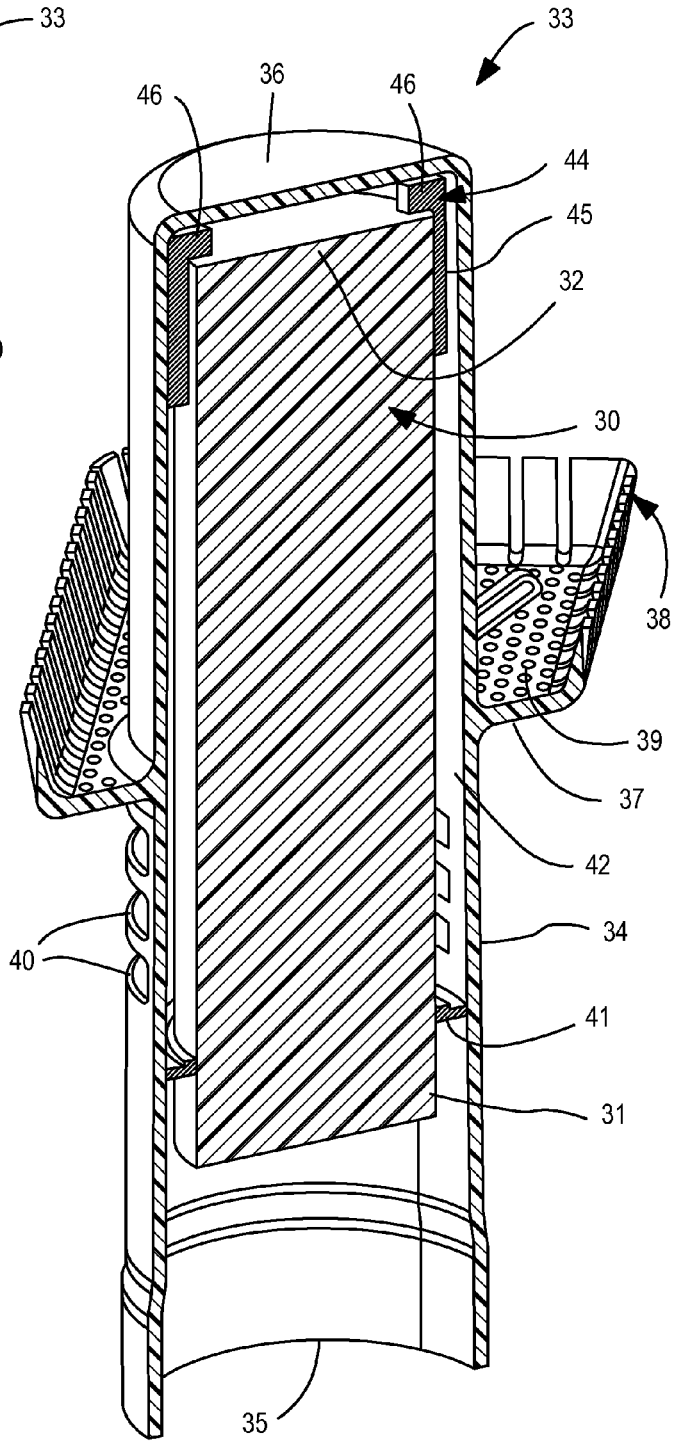
FIG. 3 is a cross section of the bleed assembly of FIG. 2.

FIG. 1 shows a bleed assembly portion of one example of a prior art evaporative emissions unit containing the carbon scrubber element mounted adjacent to an atmospheric port. The bleed assembly helps prevent hydrocarbon emissions under diurnal conditions while the main beds adsorb the main bulk of vapors during refueling. A main housing 10 includes an outer wall 11 and an inner partition wall 12 creating a chamber 13 receiving a bleed assembly 14. After mounting bleed assembly 14, chamber 13 is packed with vapor adsorbent pellets (not shown). Atmospheric outlet port 15 may contain a remotely controllable valve for selectably opening the port to allow atmospheric external air to flow into bleed assembly 14 during purge and to allow cleaned air to flow out from unit 10 during refueling, as known in the art. Bleed element 14 includes a carbon scrubber element 16 or monolith used to capture low concentration fuel vapor as a mixture of air and fuel vapor flows from a first end 17 to a second end 18. Element 16 is elongated and has a conventional internal structure with end-to-end passages allowing gaseous flow only between ends 17 and 18. Element 16 is retained in a bleed tube 20 that is suspended within a bleed deflector 21. Since carbon element 16 is relatively delicate, it is cushioned by a foam sock 22.

Deflector 21 has a spacer plate 23 with flexible fingers that contact walls 11 and 12. Adsorbent carbon pellets are retained below spacer plate 23, and air and fuel vapors are allowed to pass from cavity 13 through spacer plate 23 into a cylindrical gap 24 between deflector 21 and bleed tube 20. The air and fuel vapors traverse down gap 24 and into an opening 25 at the lower end of bleed tube 20 for scrubbing by element 16 before the scrubbed air moves out through port 15.

In order to ensure a robust seal so that only gases that have passed through element 16 are allowed to vent to atmosphere, O-rings 26 and 27 are placed between bleed tube 20 and an outlet collar 28. The relatively high parts count of this prior art structure may make it particularly difficult to assemble and install all the subcomponents for the evaporative emissions unit. The present invention provides one molded part that performs the functions of both the deflector and the bleed tube while integrating support and cushioning for the carbon scrubber element all in one bleed element assembly that is easily installed in the evaporative emissions unit.

As shown in FIGS. 2-5, an elongated carbon element 30 with a first end 31 and a second end 32 is retained in deflector 33. Deflector 33 has a substantially cylindrical shell 34 with an open end 35 and a closed end 36. Shell 34 preferably has a cross sectional shape to match element 30, which is typically circular. A spacer plate 37 extends outwardly from shell 34 and ends with a plurality of flexible finger-like prongs 38. Spacer plate 37 may include a plurality of flow openings 39 to allow air and fuel vapors to flow from pellets retained above spacer plate 37 downward toward a plurality of vapor apertures 40 formed in shell 34. An elastomeric ring 41 has an inner edge adapted to sealingly receive element 30 and an outer edge that is over-molded by shell 34. Ring 41 is located at a longitudinal position that is intermediate of open end 35 and closed end 36 and nearest to first longitudinal end 31 of element 30. Vapor apertures 40 are located longitudinally between spacer plate 37 and elastomeric ring 41. Element 30 is suspended away from shell 34 by ring 41 thereby creating a gap 42 for the flow of air and vapor mixture received from vapor apertures 40 up to second end 32 of element 30. Vapor apertures 40 are preferably located close to elastomeric ring 41 in order to provide maximum length for the vapor path along gap 42. Spacer plate 37 may be positioned on shell 34 at any longitudinal position above vapor apertures 40 and may be at a height tailored to match the desired volume of adsorbent pellets to be loaded into the vapor emissions canister.

Second end 32 of carbon element 30 is retained by a plurality of elastomeric ribs 44 which are also over-molded within the interior surface of shell 34. Ribs 44 are located longitudinally between vapor apertures 40 and closed end 36. At least four ribs 44 are spaced around element 30 to suspend it away from shell 34 without blocking the gaseous flow entering vapor apertures 40 and progressing to second end 32 of element 30. Since elastomeric ring 41 sealingly receives carbon element 30 continuously around the circumference of element 30, and since the only flow path through element 30 is between the opposite ends 31 and 32, no additional O-rings or seals are needed to prevent vapor leakage to open end 35. Ribs 44 are disposed both radially and longitudinally against element 30 and may have any desired shapes suitable for overmolding such as pips, dimples, bumps, or elongated sections.

In a preferred embodiment, elastomeric ribs 44 each comprises an L-shaped body with a first arm 45 over-molded by the interior cylindrical surface of shell 34, wherein first arm 45 extends longitudinally away from closed end 36. The L-shaped body further comprises a second arm 46 that is over-molded into closed end 36 and extends radially toward the center axis. Thus, any movements or vibrations of element 30 (either axial or radial) are cushioned by ribs 44 and ring 41, and a foam sock as shown in prior art FIG. 1 may be eliminated.

Elastomeric ring 41 and elastomeric ribs 44 may preferably be comprised of MBR rubber which may be over-molded using conventional techniques within a deflector body comprised of nylon or polypropylene blends, for example. Preferably, the shell and spacer plate are integrally molded as one piece. More specifically, ring 41 and ribs 44 may be loaded into a molding tool which then receives molten thermoplastic to form the deflector in a manner that captures ring 41 and ribs 44.

Figure 4:
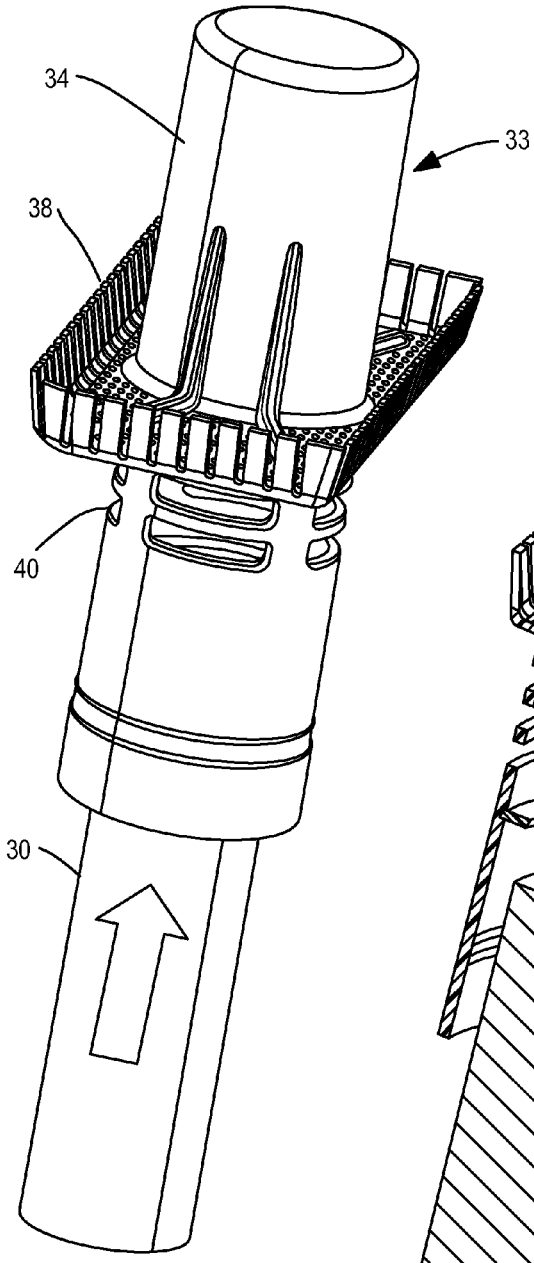
FIGS. 4 and 5 are a perspective view and a cross-sectional view, respectively, showing the insertion of the carbon scrubber element into the diverter.
Figure 5:
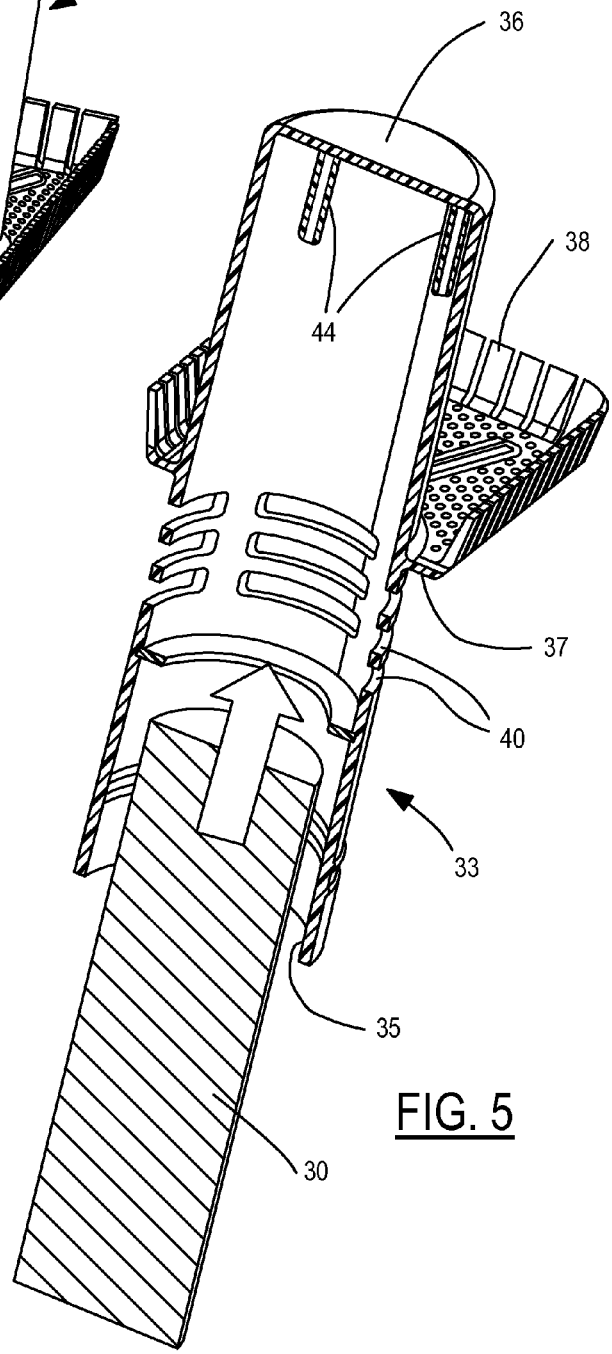
Figure 6:
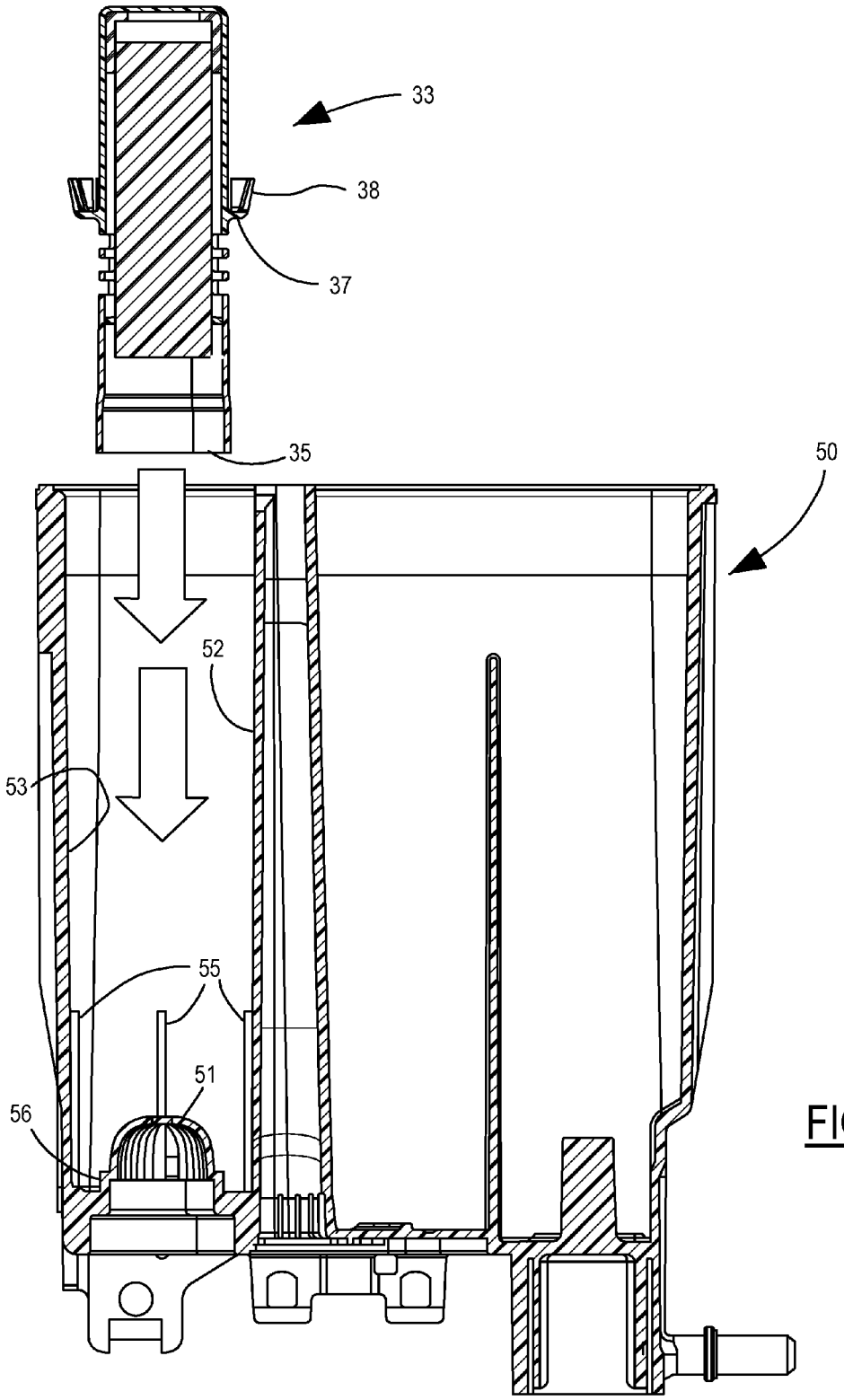
FIG. 6 is a side cross section showing the assembly of the bleed assembly into a canister.

FIGS. 4 and 5 illustrate the insertion of carbon scrubber element 30 into deflector 33 prior to installation of the bleed assembly into a canister. Prongs 38 are configured to be compressed against inner walls of a canister 50 when deflector 33 is assembled into canister 50 as shown in FIG. 6. As known in the art, canister 50 includes several subchambers to receive carbon pellets that adsorb the majority of the fuel vapors during refueling. The final subchamber prior to an atmospheric port 51 has inner walls including walls 52 and 53. Port 51 may comprise an outlet including a slotted dome for receiving open end 35 of deflector 33. Open end 35 fits tightly over a shoulder 56 at the lower edge of domed outlet 51. The tight fit seals deflector 33 against canister 50 thereby preventing vapor leaks.

Figure 8:
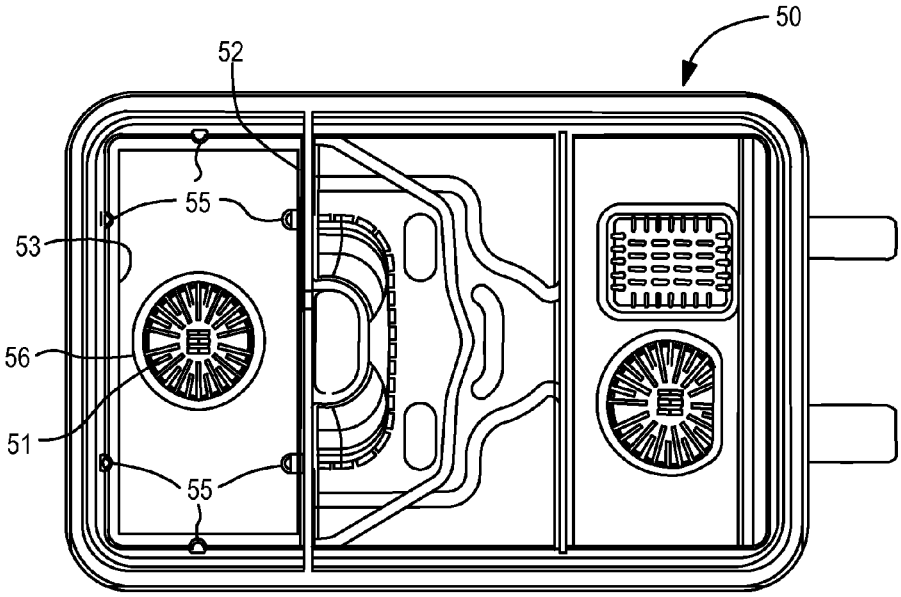
FIG. 8 is an end view of the canister housing of FIGS. 6 and 7.

The inner walls of canister 50, including walls 52 and 53, preferably include a plurality of stop ribs 55 shown in FIGS. 6 and 8. Each stop rib 55 has an upper end corresponding to the final position of spacer plate 37. When deflector 33 is fully installed and is properly aligned, then spacer plate 37 bottoms out against every stop rib 55. If deflector 33 is being inserted at an improper orientation, then it is straightened by contact with stop ribs 55, whereby open end 35 achieves proper orientation against shoulder 56. Once deflector 33 has been fully inserted, it is kept in place by a spring force resulting from the angled shape of prongs 38 which become compressed against the walls of canister 50.

Figure 7:
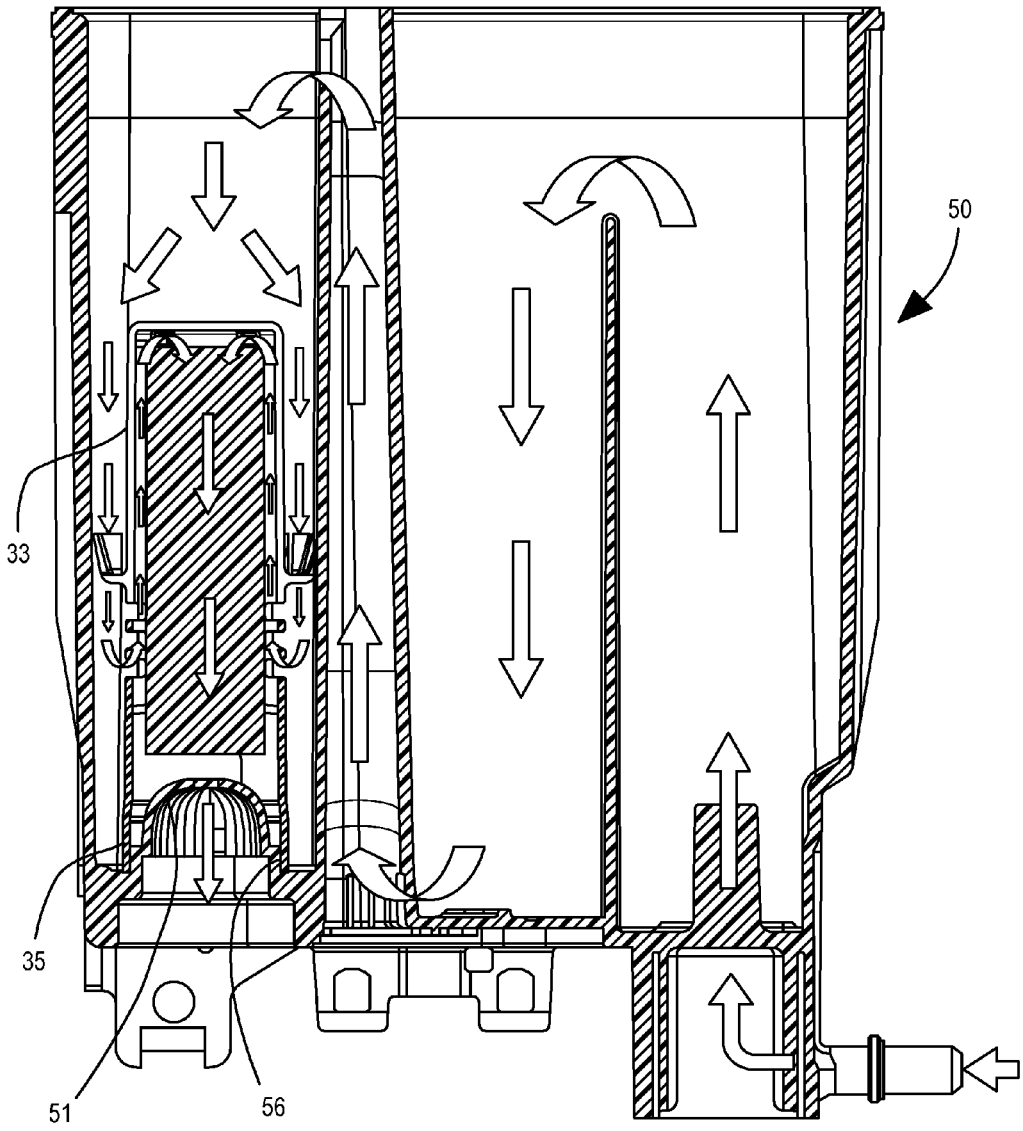
FIG. 7 is a side cross section showing the flow path within the evaporative emissions unit of FIG. 6.

FIG. 7 illustrates gaseous flow through the evaporative emissions unit during venting to external atmosphere (e.g., during refueling). The gas flow path enters the deflector 33 radially and extends longitudinally within gap 42 toward second end 32 of element 30. Elastomeric ring 41 prevents the gas from exiting open end 35 without passing through element 30. Thus, the desired path that doubles back within the deflector and passes through the carbon scrubber element is obtained using a compact and easily assembled bleed unit without requiring separate O-rings or other loose subcomponents. This design provides for improved packaging, gas flow, assembly, and serviceability of the canister. The modular design of deflector 33, as described above, provides for pre-assembly and simple serviceability of the components of this design.

What is claimed is:

1. An evaporative emissions unit for a vehicle to capture fuel vapors from a fuel tank vented to external atmosphere, comprising:

a canister body having a first port for coupling to a fuel tank and a second port for coupling to external atmosphere;

an elongated carbon element for adsorbing fuel vapors from a gaseous flow from a first longitudinal end of the carbon element to a second longitudinal end; and a deflector for mounting the carbon element within the canister body in communication with the second port, wherein the deflector comprises:

a substantially cylindrical shell having an open end and a closed end;

a spacer plate extending outwardly from the shell;

an elastomeric ring overmolded by an interior surface of the shell at a longitudinal position intermediate of the open end and the closed end, wherein the elastomeric ring sealingly receives the carbon element continuously around a circumference proximate to the first longitudinal end of the carbon element;

a plurality of vapor apertures formed in the shell located longitudinally between the spacer plate and the elastomeric ring; and a plurality of elastomeric ribs overmolded by the interior surface of the shell and located longitudinally between the vapor apertures and the closed end, wherein the elastomeric ribs are spaced around the carbon element to suspend the carbon element spaced away from the shell without blocking a gaseous flow from the vapor vents to the second longitudinal end of the carbon element;

wherein the open end of the shell sealingly connects with the second port.

2. The evaporative emissions unit of claim 1 wherein the shell and the spacer plate are integrally over-molded onto the elastomeric ring and the elastomeric ribs.

3. The evaporative emissions unit of claim 1 wherein the elastomeric ribs include at least one elongated body for receiving the carbon element.

4. The evaporative emissions unit of claim 1 wherein the elastomeric ribs are each comprised of an L-shaped body having a first arm over-molded by the interior surface of the shell extending away from the closed end.

5. The evaporative emissions unit of claim 4 wherein each L-shaped body has a second arm over-molded by the closed end.

6. The evaporative emissions unit of claim 1 wherein the spacer plate includes a plurality of flexible prongs compressed against the canister body, and wherein the unit further comprises adsorbent pellets disposed against a side of the spacer plate facing the closed end.

7. The evaporative emissions unit of claim 1 further comprising a plurality of stop ribs formed in the canister body for abutting the spacer plate to align the deflector on the second port.

8. The evaporative emissions unit of claim 1 wherein the second port comprises a slotted dome with a shoulder for sealingly receiving the open end of the shell.

9. The evaporative emissions unit of claim 1 wherein the cylindrical shell has a circular cross section.

10. A deflector for mounting a carbon scrubber element at an atmospheric port of an evaporative emissions canister, comprising:

a substantially cylindrical shell having an open end and a closed end;

a spacer plate extending outwardly from the shell;

an elastomeric ring overmolded by an interior surface of the shell at a longitudinal position intermediate of the open end and the closed end, wherein the elastomeric ring has an inner diameter configured to sealingly receive the carbon element;

a plurality of vapor apertures formed in the shell located longitudinally between the spacer plate and the elastomeric ring; and a plurality of elastomeric ribs overmolded by the interior surface of the shell and located longitudinally between the vapor apertures and the closed end, wherein the elastomeric ribs are configured to be spaced around the carbon element to suspend the carbon element spaced away from the shell without blocking a gaseous flow from the vapor vents to the carbon element;

wherein the open end of the shell is configured to sealingly connect with the atmospheric port.

11. The deflector of claim 10 wherein the shell and the spacer plate are integrally over-molded onto the elastomeric ring and the elastomeric ribs.

12. The deflector of claim 10 wherein the elastomeric ribs include at least one elongated body for receiving the carbon element.

13. The deflector of claim 10 wherein the elastomeric ribs are each comprised of an L-shaped body having a first arm over-molded by the interior surface of the shell extending away from the closed end.

14. The deflector of claim 13 wherein each L-shaped body has a second arm over-molded by the closed end.

15. The deflector of claim 10 wherein the spacer plate includes a plurality of flexible prongs configured to be compressed against the canister to fix the deflector in place.

16. The deflector of claim 10 wherein the cylindrical shell has a circular cross section.

* * * * *